United States Patent [19]

Wiand

[11] Patent Number: 4,776,862

[45] Date of Patent: Oct. 11, 1988

[54] BRAZING OF DIAMOND

[76] Inventor: Ronald C. Wiand, 18500 Fairway Dr., Detroit, Mich. 48221

[21] Appl. No.: 129,832

[22] Filed: Dec. 8, 1987

[51] Int. Cl.[4] ..... B24D 3/00

[52] U.S. Cl. ..... 51/293; 51/295; 51/309; 228/122

[58] Field of Search ..... 51/293, 295, 309; 228/121, 122

[56] References Cited

U.S. PATENT DOCUMENTS

| | | | |
|---|---|---|---|
| 3,192,620 | 7/1965 | Huizing et al. | 228/122 |
| 4,009,027 | 2/1977 | Naidich et al. | 228/121 |
| 4,018,576 | 4/1977 | Lowder et al. | 51/309 |
| 4,527,998 | 7/1985 | Knemeyer | 51/293 |
| 4,610,699 | 9/1986 | Yazu et al. | 51/293 |
| 4,682,987 | 7/1987 | Brady et al. | 51/293 |

*Primary Examiner*—A. Lionel Clingman
*Assistant Examiner*—Willie J. Thompson
*Attorney, Agent, or Firm*—Harness, Dickey & Pierce

[57] ABSTRACT

A monolayer diamond tool is made by coating diamond abrasive particles with a carbide-forming metal and then brazing the coated diamond to a tool substrate.

12 Claims, No Drawings

BRAZING OF DIAMOND

BACKGROUND AND SUMMARY OF THE INVENTION

The present invention relates to diamond tools. More particularly, the present invention relates to a method of brazing diamond abrasive particles to a substrate to make a monolayer diamond abrasive or cutting tool. The present invention facilitates control of the strength with which abrasive particles are held by the bonding agent.

There are various methods of making diamond abrasive or cutting tools. The present invention is concerned with monolayer diamond abrasive tools which are tools having only a single layer of diamond abrasive particles on the tool substrate. Monolayer diamond abrasive tools encounter difficulties in regard to attaching the individual diamond abrasive particles to the tool substrate or core. This is especially the case where a brazing or soldering technique is employed.

A variety of bonding methods have heretofore been used for bonding diamond or other carbon containing abrasives by brazing or soldering. At the present time, known brazing alloys for diamond abrasive materials include alloys based on copper, silver or gold doped with additives of iron, cobalt and nickel taken either separately or in combination with one another.

Also known are brazing alloys such as, copper-titanium, silver titanium, gold titanium, tn titanium, lead-titanium, copper-molybdenum, copper zirconium, copper vanadium, gold-tantalum, gold-niobium, copper-silver-titanium, copper-gold titanium, bronze-titanium and copper-tim-titanium. The content of Ti, Mo, Zr and V in such alloys generally amounts up to 10 weight percent see, for examples, "Wetting and Interaction of Metal Melts with Surface of Diamond and Graphite", Yu. V Naidich and G. A. Kolesuichenko, "Naukova dumku" Publishers, Kiev 1967 (in Russian).

Another brazing alloy known for use with diamond is essentially an alloy of gold with 1-25 weight percent of tantalum U.S. Pat. No. 3,192,620. This alloy, however, has a high liquid-phase point (above 1050 degrees) and therefore is restricted but to a narrow field of application, since at 1050° C. and over diamond is liable to vigorously pass into a hexagonal form of carbon which adversely affects the strength of the abrasive.

Another diamond brazing alloy now in common use, consists of 75 weight percent copper and 25 weight percent of titanium.

A disadvantage of this alloy is that it is brittle and its thermal expansion factor differs substantially from that of the diamond. These properties lead to thermal stresses in finished products which, in turn, lead to rapid failure in the course of operation and consequently, high and premature wear of the tool made of such abrasives.

All of the brazing alloys described above are used also for metallization of abrasives made of diamond, cubic boron nitride, corundum, etc. Apart from the alloys discussed above, there are also known some alloys and single metals for surface metallization of abrasive, Viz., diamond, cubic boron nitride, silicon carbide, and tungsten carbide, the metallization being either single or multiple-layer. For establishing the initial layer, use is made of nickel, copper, zinc, tin, gold, lead, or their alloys; if a second layer is desired, iron-nickel alloy is used or the like. For the third layer copper or bronze is commonly used.

The coated crystals are then used to make polycrystalline diamond compacts as are commonly used in sintered metal bonded abrasive and cutting tools.

It is known in the art to metallize diamond and abrasives using alloys of silver-gold-titanium-cobalt-tantalum, copper-tin-tungsten and/or molybdenum-tantalum-nickel and/or cobalt-lead and/or bismuth-titanium and/or zirconium. Alloys used for brazing feature the use of an alloy of copper-tin-tungsten, molybdenum-tantalum-titanium and/or zirconium-cobalt and/or nickel-lead and/or bismuth (see, for example U.S. Pat. No. 4,009,027).

Yet another known brazing alloy contains nickel and/or cobalt-chromium-boron and/or silicon and/or phosphorous (see for example U.S. Pat. No. 4,018,576). Chromium is claimed to wet the surface of the diamond causing tenacious adhesion of the diamond to the braze.

One common disadvantage of the above methods is that they are limited in the scope of their ability to vary the strength with which the braze bonds to the diamond. Another disadvantage of some methods is their use of costly precious metals and vacuums of $10^{-5}$ torr. Even the use of metals such as copper is not economical as they cannot be processed without the use of a high vacuum or expensive dry hydrogen furnaces so as not to form hydrides of the active metals.

Furthermore, most processes in the art heretofore required that two separate costly operations be performed; first coating the abrasive by metallizing or the like and then applying a braze in an additional operation.

There remains a need, however, for an improved low cost practical method of brazing a monolayer of diamond particles to a tool substrate. In accordance with the present invention, diamond particles are precoated with a carbide forming substance and then brazed to a tool substrate. By varying the carbide forming substance, it's thickness of coating or processing time and/or temperature the degree of bond strength can be varied to produce tools for vast areas of use.

DESCRIPTION OF THE INVENTION

Generally speaking the present invention involves the steps of:

(A) pre-coating diamond with a carbide forming metal;

(B) heating the pre-coated diamond of step (A) to a temperature sufficient to form a metal carbide coating therein; and (C) brazing said coated diamond of step (B) to a substrate with a braze which alloys with said metal carbide coating.

In accordance with the first step of the present invention, synthetic or natural diamond particles are precoated with a carbide forming metal. Suitable carbide forming metals are well known in the art and include, for example, iron, molybdenum, chromium, titanium, zirconium, tungsten, niobium, vanadium, manganese, germanium and silicon, and mixtures thereof. It will be appreciated that such carbide forming metals can be used in the form of their carbide forming compounds such as molybdenum silicide or tungsten carbide the free metal of which can form carbides. Iron and molybdenum are preferred metals. The method of applying the pre-coating is not critical so long as the metal powder is held in close contact with the diamond surface.

One method which has been found satisfactory is to wet the diamond particles with a liquid such as water, mineral oil or an organic binder and then apply fine carbide forming metal powders to form a coating. Powders of 325 mesh or finer are preferred. It is important that the carbide forming compound layer be of sufficient thickness to form carbides with substantially all of the carbon released from the surface of the diamond during the brazing step. The exact thickness necessary will, of course, vary with the temperature and time of the brazing step. Alternatively the coating step can be carried out by mixing carbide forming metal powder with a binder and contacting the diamond therewith or by any conventional coating method.

In accordance with the second step of this invention, the pre-coated diamond of the first step is heated to a temperature at which the diamond begins to graphitize and release carbon atoms which come into contact with the metal atoms in the metal powder and react therewith to form metal carbide. Then, a metal carbide coating is provided on the diamond surface. The metal carbide layer is chemically bonded to the diamond surface and, hence, is a strongly attached coating for subsequent bonding to the tool substrate.

In accordance with the second step of this invention, the coated diamond is brazed to a tool substrate. Suitable tool substrates include metal cores and the like commonly employed as diamond tool substrates. Suitable brazes include nickel, silver, gold or copper based brazes. Suitable brazes are commercially available, for example, from Wall Colmonoy Corporation of Detroit, Mich. under the Nicrobraz line. It will be appreciated by those skilled in the art that the second and third steps of this invention can be carried out in a single heating step. Thus, during the brazing step, the diamond can be heated to a temperature sufficient to cause graphitization at the diamond surface and to form the desired metal carbide coating. Formations of the metal carbide facilitates wetting of the diamond surface by the braze metal which can be heated simultaneously with the pre-coated diamond. The time and temperature of the heating step or steps are determined by the particular carbide forming metal and braze composition chosen for use. Upper limits are determined by excessive graphitization or even complete breaking down of the diamond. Lower limits are functionally determined in that sufficient heating must be maintained to form the metal carbides and to melt the braze composition.

The braze is selected to be compatible, i.e., to alloy with the metal carbide on the diamond surface. Thus, good wetting of the diamond carbide interface is achieved and a strong braze bond is obtained.

Further understanding of the present invention will be had from the following examples:

EXAMPLE 1

A toric curve generating wheel for ophthalmic lenses is made as follows.

50 cts of 30/40 grit natural diamond grit is mixed with 2 drops of mineral oil. The diamond surfaces are wet by the mineral oil.

Then 2 grams of fine iron powder (6 micron) is added to a small glass vial and the oiled diamond grit is added to the vial. A stopper is placed on the vial and the vial is shaken vigorously to thoroughly mix the contents and coat the diamond grit with iron powder. The contents of the vial are then poured onto a 60 mesh sieve which is gently agitated to remove excess iron powder.

The abrading surface of a diamond generating wheel core is coated with a mixture of Wall Colomony "S" binder and a braze comprising:

| Ingredient | % By Weight |
|---|---|
| iron | 10.0 |
| silicon | 4.1 |
| boron | 2.8 |
| nickel | balance |

A part of the iron powder coated diamond grit is applied uniformly in a single layer over the braze/binder layer. The coated core is placed in a conventional vacuum furnace and heated to about 1885° F. under a vacuum of $10^{-4}$ Torr for about 1 hour and then allowed to cool.

The diamond grit is wet by the braze and is tenaciously held by the braze to the core.

COMPARATIVE EXAMPLE 2

The steps of Example 1 are carried out except that the diamond is nickel clad 30/40 grit natural and the braze is Nicrobraz 130, available from Wall Colmonoy Corp comprising:

| Ingredient | % By Weight |
|---|---|
| boron | 3.1 |
| silicon | 4.5 |
| carbon | 0.06 |
| nickel | balance |

The diamond grit is wet by the braze but held with low bond strength.

EXAMPLE 3

The steps of Example 1 are carried out except molybdenum silicide powder (325 mesh) is substituted for the iron powder and the following braze is substituted for the braze of Example 1:

| Ingredient | % By Weight |
|---|---|
| molybdenum silicide | 10 |
| silicon | 4.1 |
| boron | 2.8 |
| nickel | balance |

The diamond grit is wet by the braze and even more tenaciously held than in Example 1.

COMPARATIVE EXAMPLE 4

The steps of Example 1 are carried out except that the diamond is nickel clad 30/40 grit natural, powdered chromium is substituted for the iron powder, and the following braze is substituted for the braze of Example 1:

| Ingredient | % By Weight |
|---|---|
| iron | 10 |
| silicon | 4.1 |
| boron | 2.8 |
| nickel | balance |

The diamond is wet by the braze but less tenaciously held than in Example 1.

EXAMPLE 5

The steps of Example 1 are carried out except that 30/40 grit chromium metal clad synthetic diamond is substituted for the diamond of Example 1 and the braze of Example 2 is used.

The diamond is wet and tenaciously held by the braze.

EXAMPLE 6

The steps of Example 1 are carried out except the temperature is reduced to 1875° F. and the time at temperature is reduced to 45 minutes.

The diamond grit is wet with the braze but not strongly bonded to the braze.

EXAMPLE 7

The peripheral surface of a lens edging wheel core is coated with Wall Colmonoy "S" binder. While the binder is still wet 30/40 grit natural diamond is sprinkled onto the periphery of the core and captured in place by the binder. After the binder dries a light spray of Wall Colmonoy binder and 6 micron iron powder are applied to the periphery of wheel core by atomizing, to coat the 30/40 grit diamond. Then a brazing alloy is atomized on top of the previously applied constituents.

| Ingredient | % By Weight |
|---|---|
| iron | 10.0 |
| silicon | 4.1 |
| boron | 2.8 |
| nickel | balance |

The core is placed in a conventional vacuum furnace and heated to about 1885° F. under a vacuum of $10^{-4}$ torr for about 1 hour and then allowed to cool.

The diamond grit was wet by the braze and tenaciously held by the braze.

What is claimed is:

1. A method of making a diamond cutting or abrading tool comprising the steps of:

(A) pre-coating diamond particles with a carbide-forming metal;

(B) heating the pre-coated diamond of step (A) to a temperature sufficient to form a metal carbide coating thereon; and (C) brazing the coated diamond with a braze which alloys with said metal carbide coating.

2. The method of claim 1 wherein said carbide forming metal is a powder.

3. The method of claim 1 wherein said carbide forming metal is iron.

4. The method of claim 1 wherein said carbide forming metal is molybdenum.

5. The method of claim 1 wherein said carbide forming metal is chromium.

6. The method of claim 3 wherein said braze is a nickel based braze.

7. The method of claim 4 wherein said braze is a nickel based braze.

8. The method of claim 1 wherein said braze comprises from about 1% to about 20% of said carbide forming metal.

9. The method of claim 4 wherein said braze contains from about 1% to about 10% iron.

10. The method of claim 4 wherein said braze contains from about 1% to about 20% molybdenum.

11. A method of making a diamond cutting or abrading tool comprising the steps of:

(A) pre-coating diamond particles with a carbide-forming metal powder comprising molybdenum;

(B) heating the pre-coated diamond of step (A) to a temperature sufficient to form a molybdenum carbide coating thereon; and (C) brazing the coated diamond with a braze which alloys with said molybdenum carbide coating and which comprises from about 1% to about 20% molybdenum.

12. A method of making a diamond cutting or abrading tool comprising the steps of:

(A) pre-coating diamond particles with a carbide-forming metal powder comprising iron;

(B) heating the pre-coated diamond of step (A) to a temperature sufficient to form an iron carbide coating thereon; and (C) brazing the coated diamond with a braze which alloys with said iron carbide coating and which comprises from about 1% to about 10% iron.

* * * * *